US008267109B2

(12) United States Patent
Hygema

(10) Patent No.: US 8,267,109 B2
(45) Date of Patent: Sep. 18, 2012

(54) WATER VACUUM BREAK ASSEMBLY AND METHOD FOR SELECTIVELY ACCOMMODATING MULTIPLE CONTROL SYSTEMS

(75) Inventor: Terry L. Hygema, Greer, SC (US)

(73) Assignee: Group Dekko, Inc., Garrett, IN (US)

( * ) Notice: Subject to any disclaimer, the term of this patent is extended or adjusted under 35 U.S.C. 154(b) by 989 days.

(21) Appl. No.: 11/683,212

(22) Filed: Mar. 7, 2007

(65) Prior Publication Data

US 2007/0151102 A1 Jul. 5, 2007

Related U.S. Application Data

(63) Continuation-in-part of application No. 11/430,320, filed on May 9, 2006, now Pat. No. 7,673,480, and a continuation-in-part of application No. 11/243,429, filed on Oct. 4, 2005, now Pat. No. 8,006,523.

(60) Provisional application No. 60/679,527, filed on May 10, 2005, provisional application No. 60/615,870, filed on Oct. 5, 2004.

(51) Int. Cl.
*E03C 1/10* (2006.01)
*F16K 43/00* (2006.01)

(52) U.S. Cl. ..... 137/15.17; 137/216

(58) Field of Classification Search ..... 137/526, 137/215–217, 15.17

See application file for complete search history.

(56) References Cited

U.S. PATENT DOCUMENTS

| | | | | |
|---|---|---|---|---|
| 3,556,446 | A | 1/1971 | Bochan | 248/17 |
| 3,556,466 | A | 1/1971 | Bochan | 248/17 |
| 3,707,857 | A * | 1/1973 | Wigfall | 68/12.27 |
| 4,031,911 | A * | 6/1977 | Frazar | 137/3 |
| 4,119,116 | A | 10/1978 | Johnson et al. | 137/387 |
| 4,580,421 | A * | 4/1986 | Babuin et al. | 68/12.13 |
| 4,643,350 | A * | 2/1987 | DeSchaaf et al. | 236/12.12 |
| 4,711,103 | A * | 12/1987 | Mori et al. | 68/12.05 |
| 5,184,635 | A * | 2/1993 | Tromblee et al. | 134/111 |
| 5,217,288 | A | 6/1993 | Johnson | 312/257.1 |
| 5,347,610 | A * | 9/1994 | Lee | 392/447 |
| 5,351,892 | A | 10/1994 | Conte | 239/304 |
| 5,394,582 | A * | 3/1995 | Moon | 8/158 |
| 5,752,393 | A | 5/1998 | Schlosser et al. | 62/303 |
| 6,246,831 | B1 * | 6/2001 | Seitz et al. | 392/486 |
| 6,347,645 | B2 | 2/2002 | Gurubatham et al. | 137/831 |
| 7,543,598 | B1 | 6/2009 | Hygema | |

* cited by examiner

*Primary Examiner* — John Rivell
*Assistant Examiner* — David Colon Morales
(74) *Attorney, Agent, or Firm* — Taylor IP, P.C.

(57) ABSTRACT

The present invention provides a water vacuum break assembly for use in a washing machine and a method of assembling the water vacuum break assembly. The water vacuum break assembly includes a housing defining at least one water inlet opening, a water cavity fluidly connected with the at least one water inlet opening, and a control system cavity positioned proximate the water cavity, the control system cavity configured for selectively retaining one of at least two differently configured control systems configured for sensing and/or regulating a temperature of water in the water cavity.

5 Claims, 13 Drawing Sheets

WATER VACUUM BREAK ASSEMBLY AND METHOD FOR SELECTIVELY ACCOMMODATING MULTIPLE CONTROL SYSTEMS

CROSS REFERENCE TO RELATED APPLICATIONS

This is a continuation-in-part of U.S. patent application Ser. No. 11/243,429, entitled "WATER VALVE SNAP FIT RETENTION FOR A VACUUM BREAK BACKGROUND OF THE INVENTION", filed Oct. 4, 2005, now U.S. Pat. No. 8,006,523, which is incorporated by reference herein, and a continuation-in-part of U.S. patent application Ser. No. 11/430,320, entitled "MOUNTING AND METHOD FOR MOUNTING A WATER VACUUM BREAK", filed May 9, 2006, now U.S. Pat. No. 7,673,480, which is incorporated by reference herein. U.S. patent application Ser. No. 11/243,429 is a non-provisional application based upon U.S. provisional patent application Ser. No. 60/615,870, entitled "WATER VALVE SNAP-FIT RETENTION FOR VACUUM BREAK ASSEMBLY", filed Oct. 5, 2004, which is incorporated by reference herein. U.S. patent application Ser. No. 11/430,320 is a non-provisional application based upon U.S. provisional patent application Ser. No. 60/679,527, entitled "MOUNTING METHOD FOR WATER VACUUM BREAK", filed May 10, 2005, which is incorporated by reference herein.

BACKGROUND OF THE INVENTION

1. Field of the Invention

The present invention relates to washing machines, and, more particularly, to a water vacuum break assembly for use in a washing machine and a method for assembling a water vacuum break assembly for use in a washing machine.

2. Description of the Related Art

Water vacuum breaks are utilized in water systems to prevent a siphoning action from occurring between a device utilizing water and the water supply. For example, vacuum breaks are utilized in certain toilet flushing systems so that there is an opportunity for air to enter between the water source and the water being used by the device. Another application for vacuum breaks is in washing machines where the water supply may be a mixture of hot and cold water that is then supplied to a washing tub, the vacuum break serving the dual function of mixing the hot and cold water in a mixing chamber and providing a break between the water supply and the water in the washing tub. Vacuum breaks for washing machines allow for the introduction of atmospheric air in the water flow so that a siphon is not created that would draw additional water from the source or allow contamination from a water path that may be in contact with water in the tub and the valve.

A water temperature sensing and control apparatus for automatic washers can have a thermistor mounted within a projection that extends into a water inlet stream in a water inlet housing. A control circuit connected to the thermistor includes a pair of comparators for controlling hot and cold water inlet valves in response to the sensed temperature to achieve one of a plurality of selectable wash bath temperatures.

What is needed in the art is a water vacuum break assembly that can selectively accommodate, in a simple manner, one of at least two differently configured control systems.

SUMMARY OF THE INVENTION

The present invention provides a water vacuum break assembly that can selectively accommodate, in a simple manner, one of at least two differently configured control systems, including a thermistor assembly and a thermostat assembly having one or two thermostats.

The invention in one form is directed to a water vacuum break assembly for use in a washing machine, the water vacuum break assembly including a housing defining at least one water inlet opening, a water cavity fluidly connected with the at least one water inlet opening, and a control system cavity positioned proximate the water cavity, the control system cavity configured for selectively retaining one of at least two differently configured control systems configured for sensing and/or regulating a temperature of water in the water cavity.

The invention in another form is directed to a method of assembling a water vacuum break assembly for use in a washing machine, the method including the steps of providing, inserting, and retaining. The providing step includes providing a water vacuum break housing defining at least one water inlet opening, a water cavity fluidly connected with the at least one water inlet opening, and a control system cavity positioned proximate the water cavity, the control system cavity configured for selectively retaining one of at least two differently configured control systems including a first control system. The inserting step includes inserting the first control system in the control system cavity, the first control system configured for sensing and/or regulating a temperature of water in the water cavity. The retaining step includes retaining the first control system in the control system cavity.

The invention in yet another form is directed to a washing machine including an enclosure and a water vacuum break assembly attached to the enclosure. The water vacuum break assembly includes a housing defining at least one water inlet opening, a water cavity fluidly connected with the at least one water inlet opening, and a control system cavity positioned proximate the water cavity, the control system cavity configured for selectively retaining one of at least two differently configured control systems configured for sensing and/or regulating a temperature of water in the water cavity.

An advantage of the present invention is that it can, in a simple manner, selectively accommodate one of at least two differently configured control systems in a single universal part.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrates embodiments of the invention, and such exemplifications are not to be construed as limiting the scope of the invention in any manner.

DETAILED DESCRIPTION OF THE INVENTION

Figure 1:
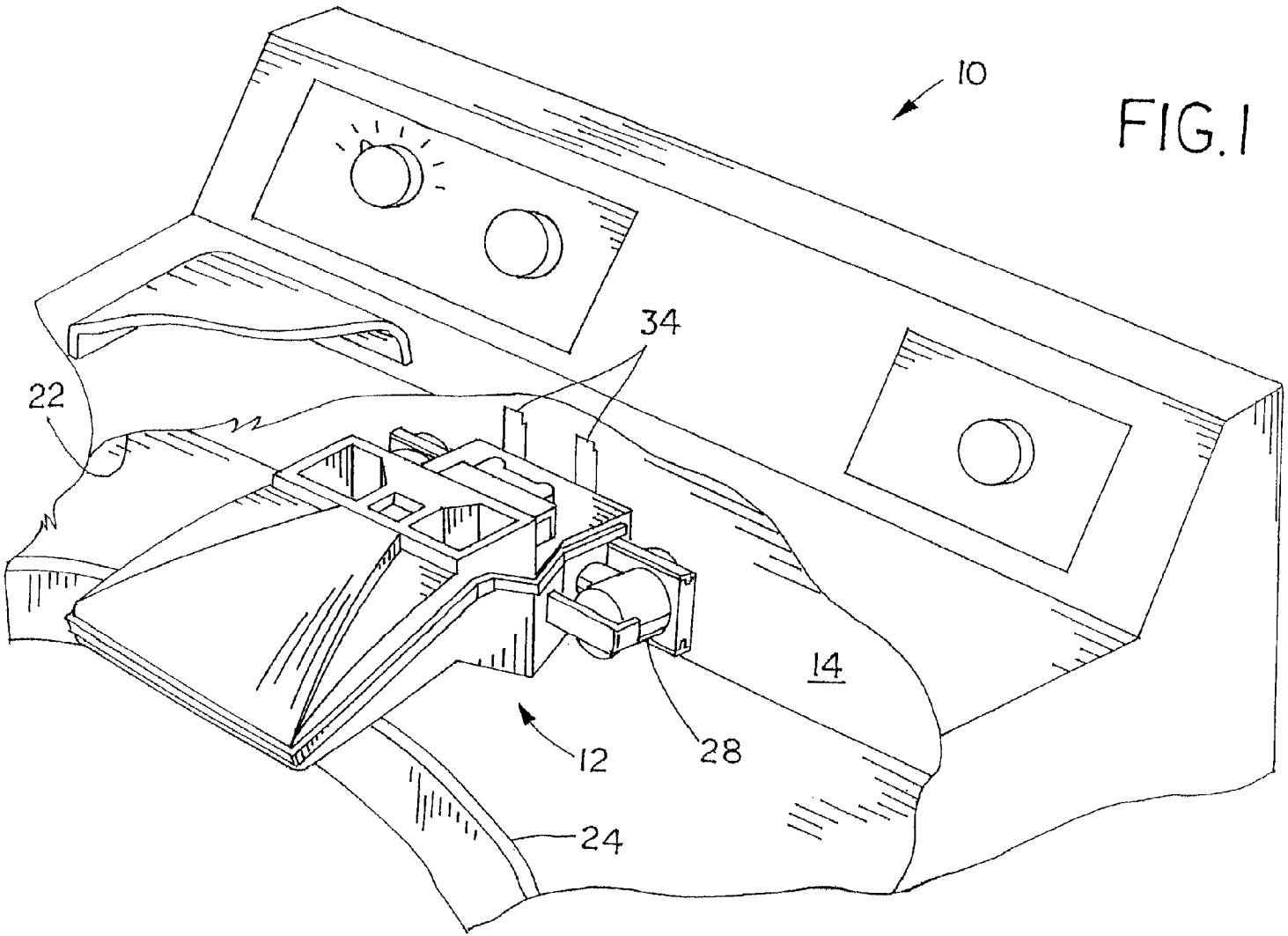
FIG. 1 is a perspective view of a washing machine showing a water vacuum break assembly.
Figure 2:
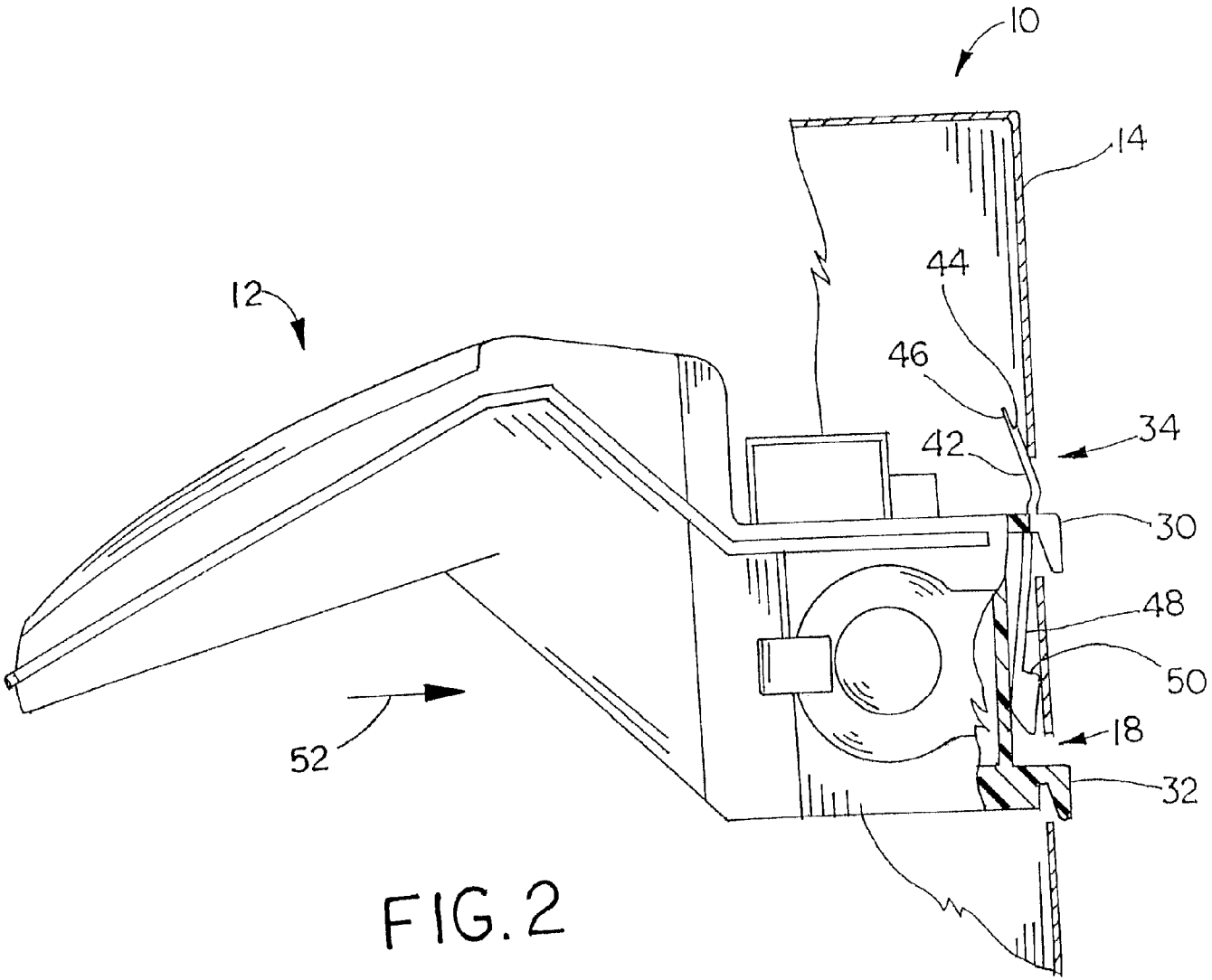
FIG. 2 is a partial cross-sectional view of the washing machine of FIG. 1 illustrating the water vacuum break assembly of FIG. 1 being inserted into a portion of the washing machine.
Figure 3:
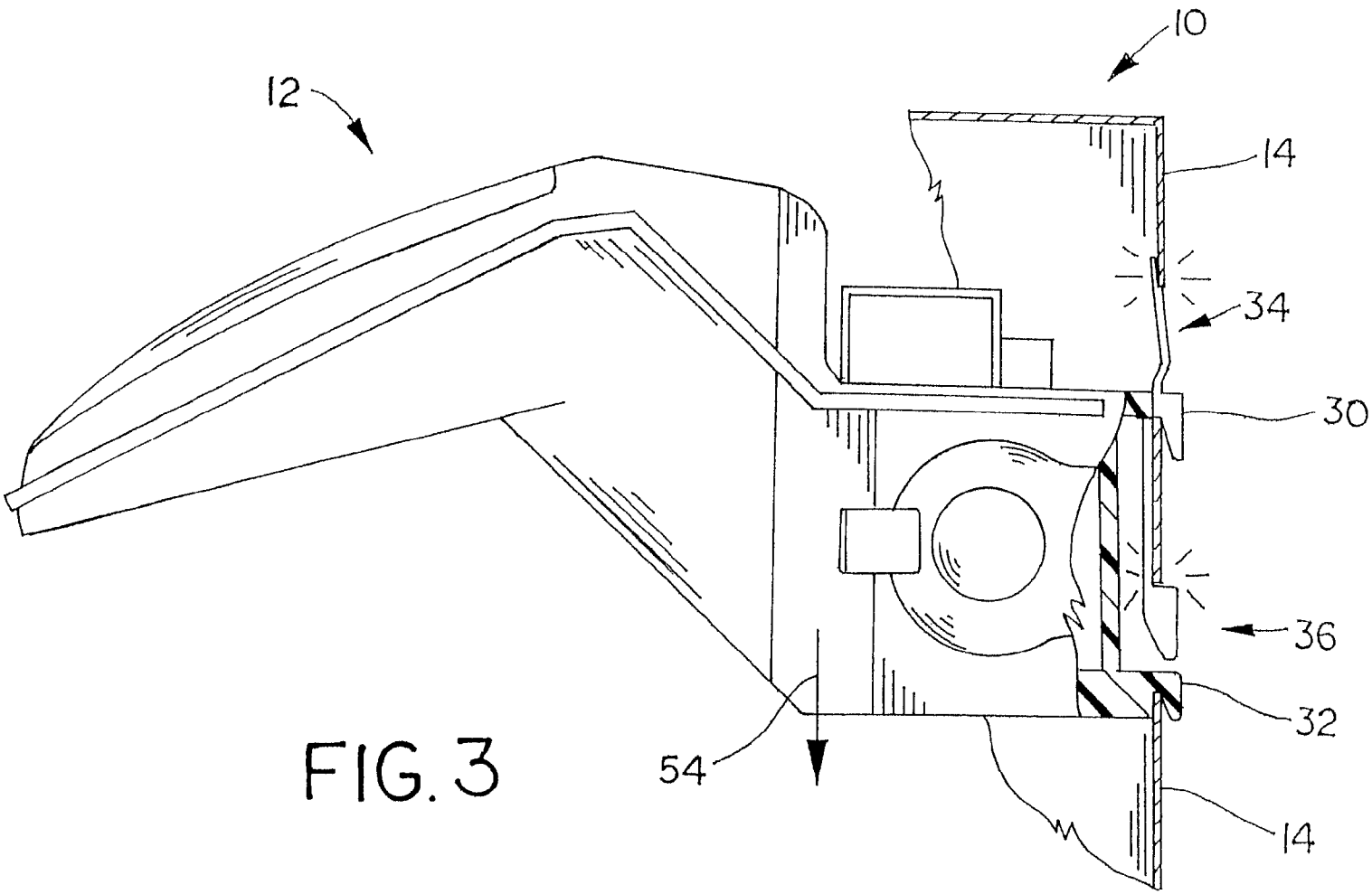
FIG. 3 is another partial cross-sectional view showing the water vacuum break assembly of FIGS. 1 and 2 being slid into a retained position.
Figure 4:
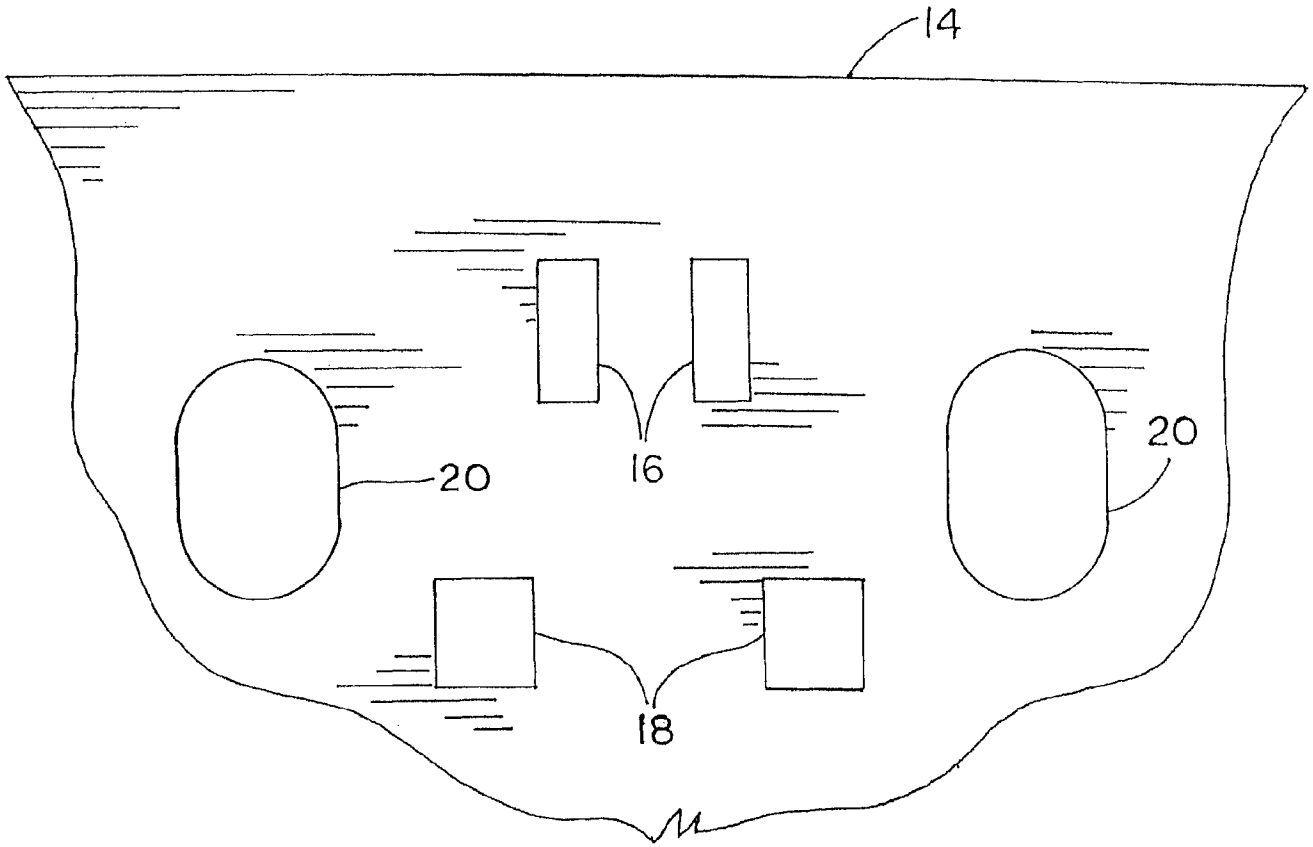
FIG. 4 is a view of slots in the washing machine of FIGS. 1-3 illustrating slots in an outer wall to accommodate the water vacuum break assembly.

Referring now to the drawings, and more particularly to FIG. 1, there is shown a washing machine 10 including a water vacuum break assembly 12 connected to washing machine 10. Washing machine 10 includes a housing (enclosure) 14 with an exterior wall of metal construct.

Now, additionally referring to FIGS. 2-5, housing 14 has a series of slots therein including upper mounting slots 16, lower mounting slots 18 and elongated curved openings 20. Slots 16 and 18 interact with connection features of vacuum break assembly 12 discussed hereinafter. Elongated curved openings 20 accommodate the insertion and sliding of hose connectors that are part of water vacuum break assembly 12. Within housing 14 there are various constraints within washing machine 10 including a top constraint 22, which may be a top portion of washing machine 10. Further the positioning of tub 24 serves as a constraint for the positioning of water vacuum break assembly 12. Water vacuum break assembly 12 supplies water to tub 24 during the operation of washing machine 10.

Figure 5:
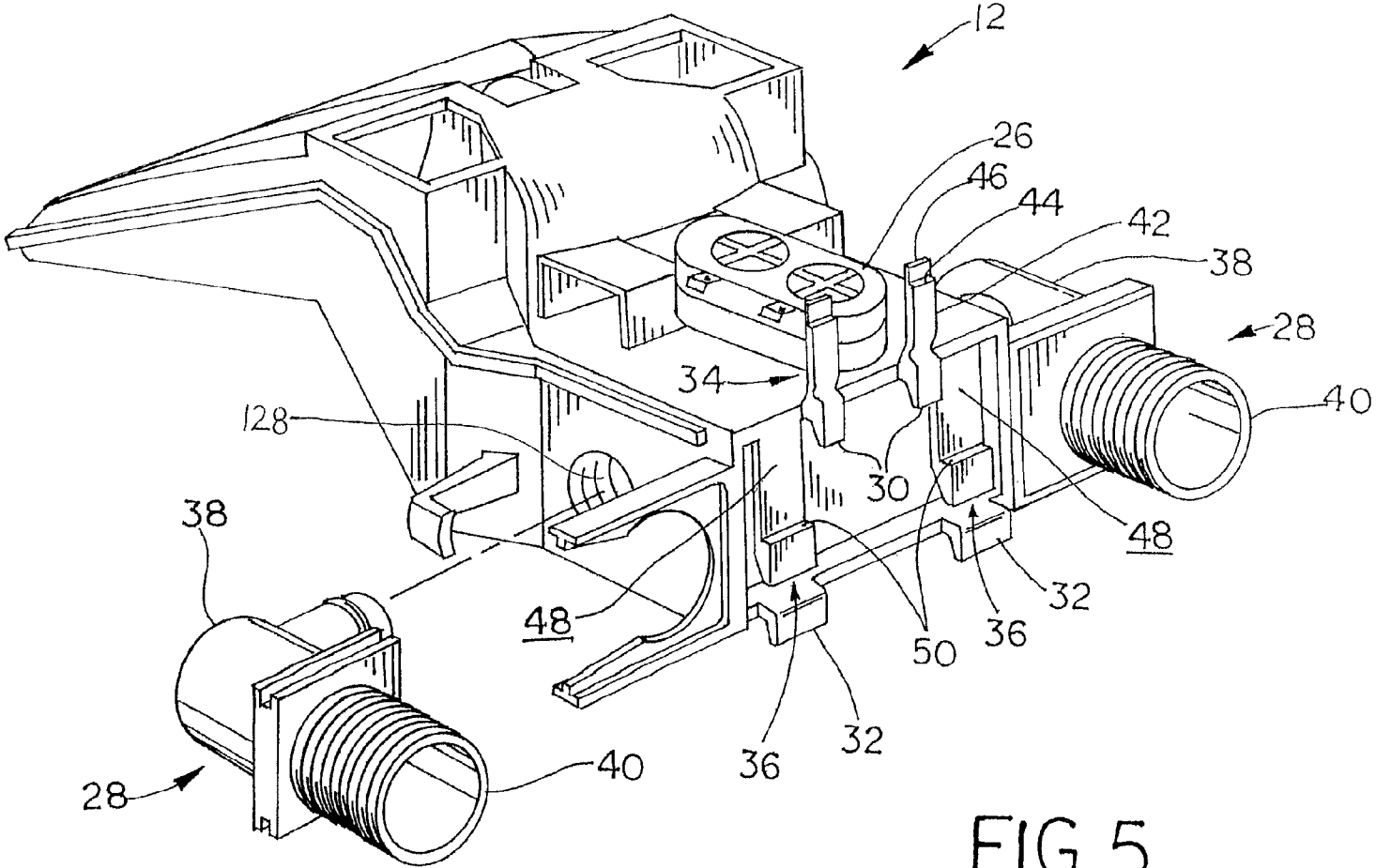
FIG. 5 is a perspective view of the water vacuum break assembly of FIGS. 1-3, with a valve assembly broken away, showing an embodiment of the water vacuum break assembly according to the present invention including a thermostat assembly.

According to one embodiment of the water vacuum break assembly of the present invention as shown in FIG. 5, water vacuum break assembly 12 includes thermal sensor assembly 26 in the form of one embodiment of a thermostat assembly, valve assemblies 28, upper grooved lips 30, lower grooved lips 32, upper retaining snaps 34, and lower retaining snaps 36. Thermal sensor assembly 26 is associated with water vacuum break assembly 12 to sense the temperature of the water passing through water vacuum break assembly 12 and the information from the sensor is sent to a controller that then provides control signals to valve assemblies 28 to control the volume and temperature of the water flowing through water vacuum break assembly 12.

Valve assemblies 28 are associated with water vacuum break assembly 12 although they can be separately located. Valve assembly 28 is located at each side of 12 and is snapped into position, one for the supplying of cold water and the other for the supplying of hot water. Valve assemblies 28 include a solenoid 38 and a hose connector 40. Solenoid 38 is electrically connected to a controller, which activates solenoid 38 at appropriate times. Hose connector 40 extends through elongated curved opening 20 when water vacuum break assembly 12 is inserted through housing 14 in direction 52 and then once inserted water vacuum break assembly 12 is moved in direction 54. Direction 52 is substantially orthogonal with the exterior wall of housing 14 and direction 54 is substantially parallel with the exterior wall of housing 14.

Grooved lips 30 and 32 are L-shaped protrusions that extend generally outwardly and downwardly from the back portion of water vacuum break assembly 12. Lips 30 and 32 are arranged so that they will extend through slots 16 and 18, respectively, and then slide over an outer portion of the exterior wall of housing 14. When grooved lips 30 and 32 are pushed into position through slots 16 and 18, and then downwardly, retaining snaps 34 and 36 snap into position to hold water vacuum break assembly 12 in a fixed position relative to the exterior wall of housing 14.

Upper retaining snaps 34 include a flexible arm 42, a retaining edge 44 and a retaining extension 46. Flexible arm 42 is molded from the same material as the bulk of water vacuum break assembly 12 and is shaped and formed to take advantage of the flexible nature of a reduced cross-sectional area of the material. Retaining edge 44 is positioned relative to the bottom of grooved lip 30 so that when grooved lip 30 is fully inserted and extends over a portion of the exterior wall of housing 14 that retaining edge 44 snaps into position within an upper mounting slot 16. Retaining extension 46 serves to not allow retaining edge 44 to extend too far through slot 16 and to additionally allow another portion of washing machine 10, not shown, to be mounted after water vacuum break assembly 12 to thereby prevent incidental disconnection of water vacuum break assembly 12 from washing machine 10. In a similar manner lower retaining snaps 36 include a flexible arm 48 and a retaining edge 50. Flexible arm 48 serves a dual purpose to allow the flexing of snap 36 and also prevents retaining edge 50 from extending too far through slot 18. As with retaining snap 34, retaining snap 36 is shaped and positioned such that when grooved lip 32 is in position retaining edge 50 engages an edge of slot 18 to prevent the removal of vacuum break assembly 12 from the exterior wall of housing 14.

The insertion of water vacuum break assembly 12 includes moving assembly 12 in first direction 52 until grooved lips 30 and 32 extend, respectively through slots 16 and 18. At this point in the operation snaps 34 and 36 are flexed away from their normal position until water vacuum break assembly 12 is moved in second direction 54 thereby allowing flexible arms 42 and 48 to return to their normal position thereby causing retaining edges 44 and 50 to engage upper portions of slots 16 and 18, respectively. In this position hose connectors 40 extend through the exterior wall of housing 14 allowing the connection of the water hose to each hose connector 40.

Figure 6:
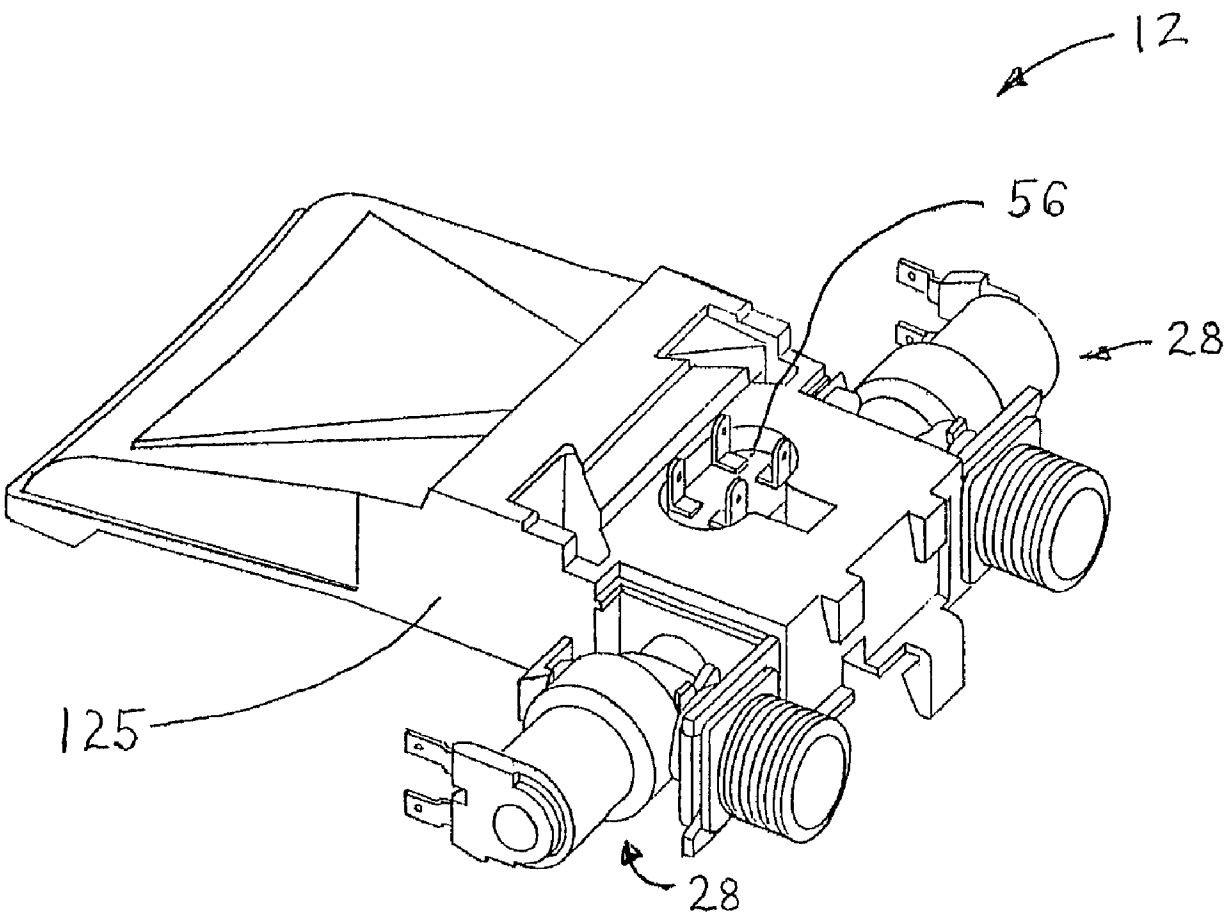
FIG. 6 is a perspective view of another embodiment of the vacuum break assembly according to the present invention including a thermistor assembly.

According to another embodiment of the water vacuum break assembly of the present invention as shown in FIG. 6, water vacuum break assembly 12 includes a housing 125 and can further include a temperature sensor 56 in the form of one embodiment of a thermistor assembly. Temperature sensor 56 is adjacent to a mixing cavity in which water from both the hot and cold supply are mixed and the temperature is controlled by a control device. Valve assemblies 28 (which are shown in various embodiments in the figures) are respectively assigned to cold and hot water supplies that are coupled in a conventional manner by way of a hose to hot and cold water supplies.

Thermal sensor assembly 26 (a thermostat assembly) and temperature sensor 56 (a thermistor assembly) each can be more generally called a control system. Differently configured control systems can be selectively placed in a well of a top surface of the housing of the vacuum break assembly. The well can be generically called a control system cavity. The control system cavity can be configured for selectively retaining one of at least two differently configured control systems configured for sensing and/or regulating the temperature of the water in a mixing cavity.

According to another embodiment of the water vacuum break assembly of the present invention as shown in FIGS. 7-18, water vacuum break assembly 12 includes a housing 126 defining two water inlet openings 128 (FIG. 5), a mixing cavity 130 fluidly connected with water inlet openings 128, and a control system cavity 132 positioned proximate mixing cavity 130. Housing 126 includes a proximal end 134 and a distal end 136. Proximal end 134 includes attachment features 138 for attaching vacuum break assembly 12 to a washing machine housing/enclosure. Distal end 136 includes a discharge portion 140 for discharging water from vacuum break assembly 12 into a washing machine tub 24.

Water inlet openings 128 permit water to enter vacuum break assembly 12. Each of the two water inlet openings 128 can be respectively coupled with a valve assembly 28. Water inlet openings 128 and respective valve assemblies 28 can be respectively assigned to hot and cold water supplies (not shown).

While vacuum break assembly 12 is described as having two water inlet openings 128, vacuum break assembly 12 can include only one water inlet opening. Additionally, while vacuum break assembly 12 is described as being coupled with two valve assemblies 28, vacuum break assembly 12 can be coupled with only one water inlet valve. Furthermore, each of the water inlet valves can be used directly or indirectly with or without a control system. Accordingly, vacuum break assembly 12 may include only one water inlet valve with or without a control system. Similarly, vacuum break assembly 12 may include a plurality of water inlet valves, each selectively with or without a control system.

Figure 7:
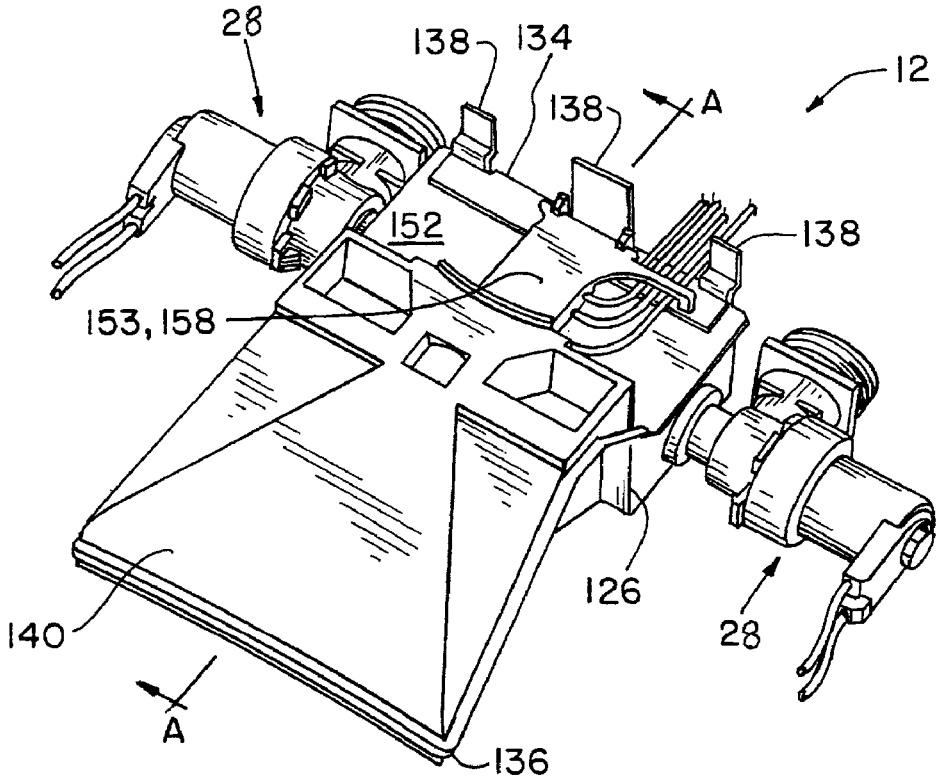
FIG. 7 is a perspective view of another embodiment of the water vacuum break assembly according to the present invention including a thermostat assembly with two thermostats.
Figure 8:
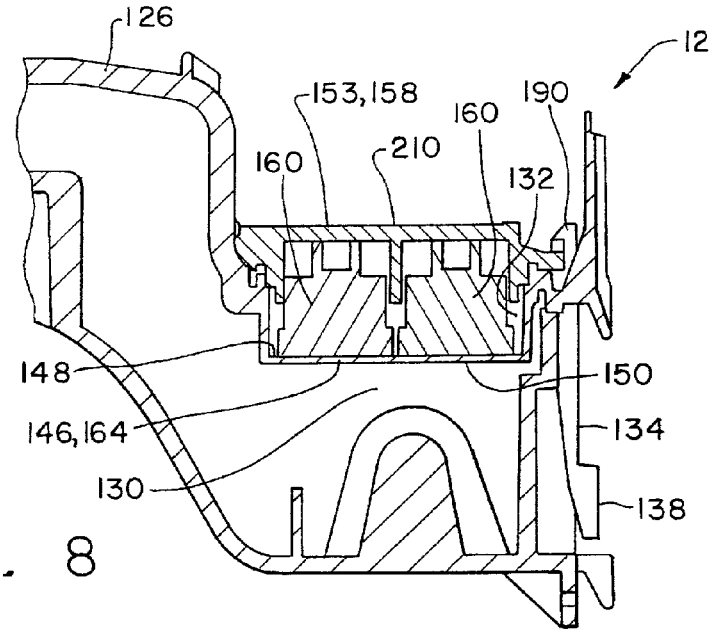
FIG. 8 is a fragmentary cross-sectional view taken along line A-A in FIG. 7.

Mixing cavity 130 (which can also be variously called a water cavity or a mixing chamber) serves as a mixing chamber for water flowing from the hot and cold water supplies and through valve assemblies 28 and water inlet openings 128. Water cavity 130 is located between water inlet openings 128, and, thus, also between valve assemblies 28, as shown in FIGS. 7-8. Valve assemblies 28 can be variously activated, directly or indirectly, by a control system 153 (a generic control system) in order to control the temperature of the water that travels through mixing chamber 130 of vacuum break assembly 12. Water, thus, flows from the hot and/or cold water supplies, through one or both valve assemblies 28, into water cavity 130, through discharge portion 140, and then out of vacuum break assembly 12 and into a washing machine tub 24.

Figure 9:
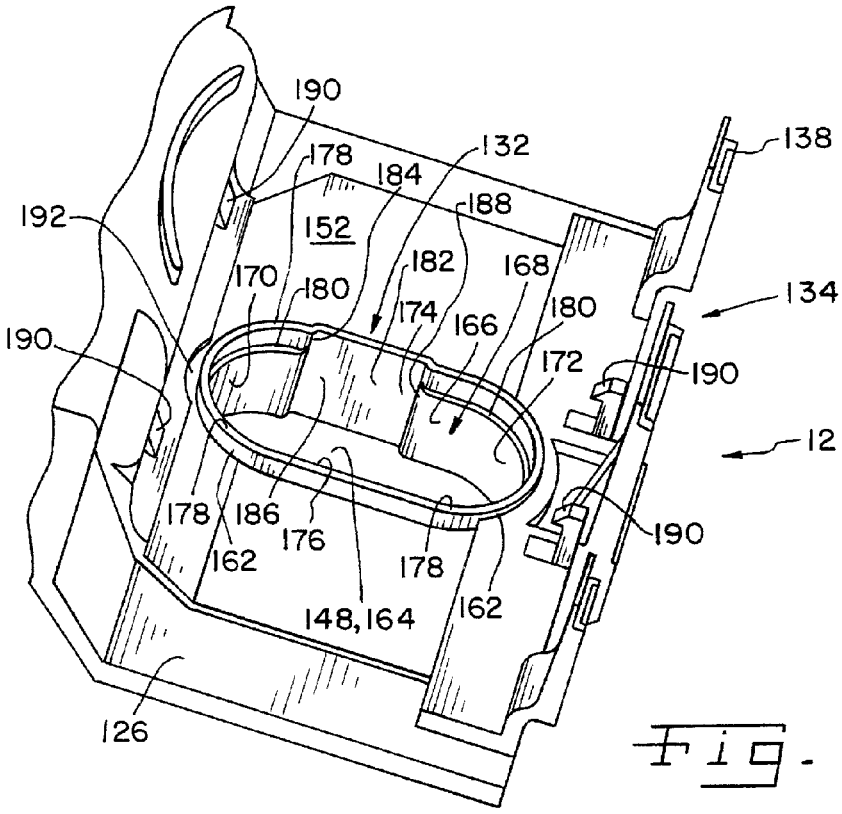
FIG. 9 is a fragmentary perspective view of the water vacuum break assembly of FIG. 7, with portions broken away, showing a top portion of the water vacuum break assembly and a control system cavity without a control system.

Control system cavity 132 is located adjacent water cavity 130. Specifically, control system cavity 132 can be located atop water cavity 130, as shown in FIG. 8. A common wall 146 can separate control system cavity 132 and water cavity 130, housing 126 including common wall 146. Control system cavity 132 can be disposed adjacent a top surface 148 of common wall 146, and water cavity 130 can be disposed adjacent a bottom surface 150 of common wall 146. Control system cavity 132 can be a single well or depression in a top surface 152 of housing 126 of vacuum break assembly 12, as shown in FIG. 9. Alternatively, control system cavity 132 can include a plurality of wells, depressions, and/or pockets.

Figure 10:
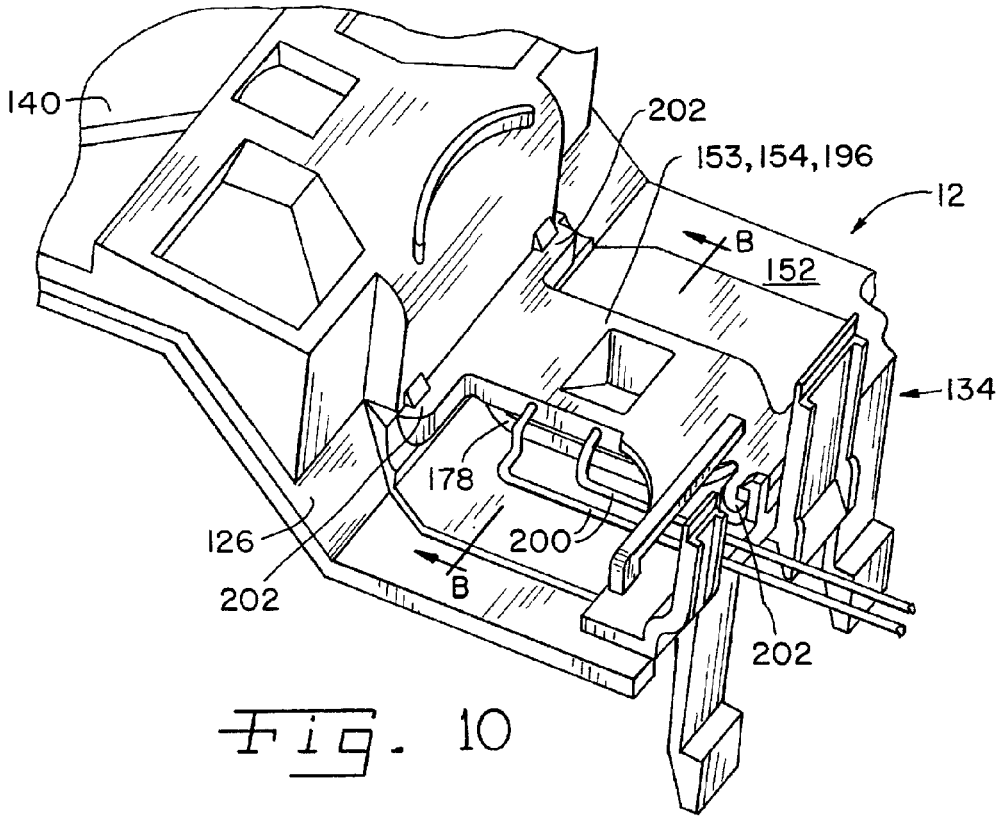
FIG. 10 is a fragmentary perspective view of the water vacuum break assembly of FIG. 7, with portions broken away, showing a top portion of the water vacuum break assembly and a thermistor assembly (rather than the thermostat assembly with two thermostats)
Figure 11:
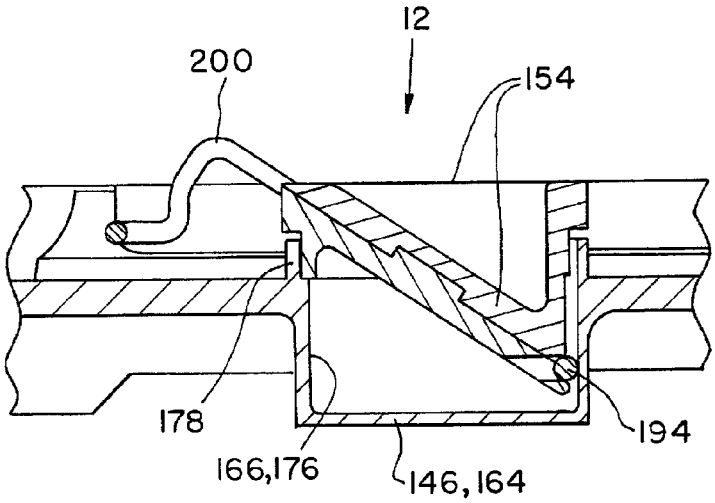
FIG. 11 is a fragmentary cross-sectional view taken along line B-B in FIG. 10.
Figure 12:
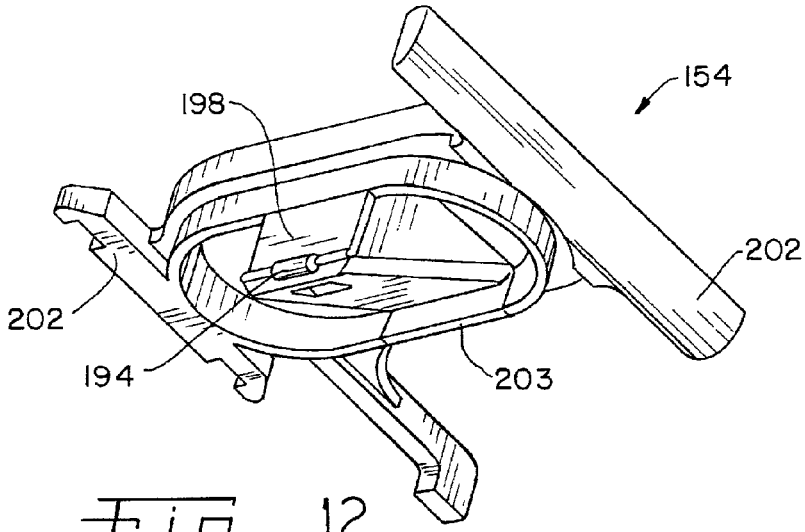
FIG. 12 is a perspective view showing the thermistor assembly in FIG. 10 less wires.
Figure 13:
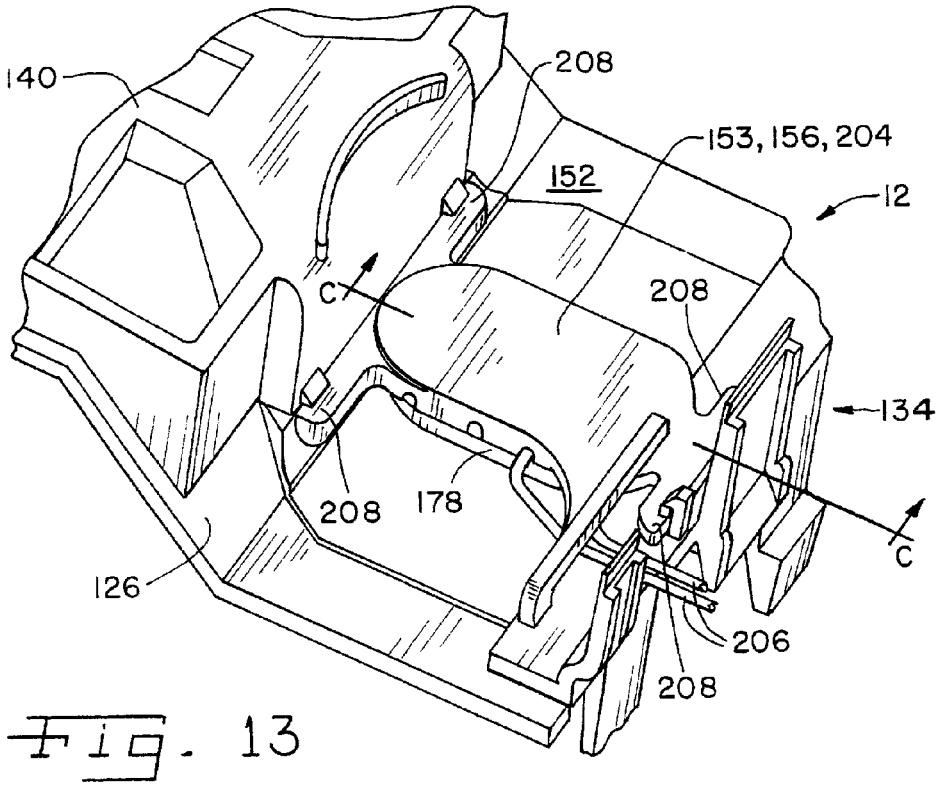
FIG. 13 is a fragmentary perspective view of the water vacuum break assembly of FIG. 7, with portions broken away, showing a top portion of the water vacuum break assembly and a thermostat assembly with a single thermostat (rather than the thermostat assembly with two thermostats)
Figure 14:
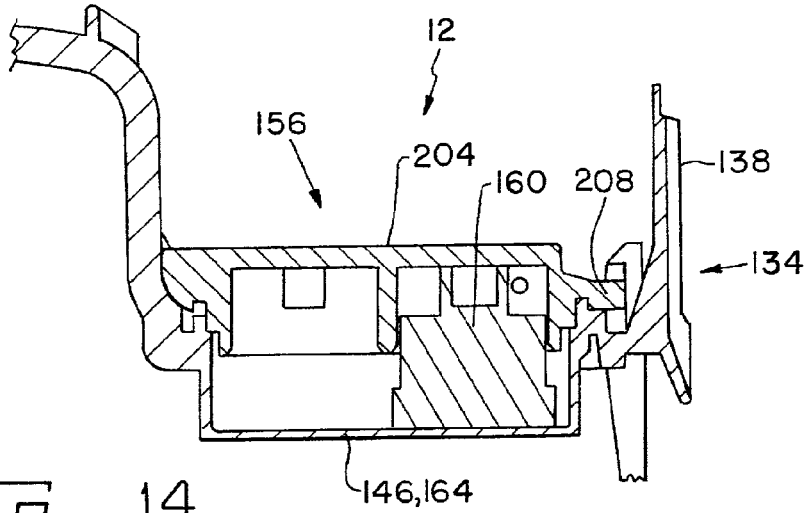
FIG. 14 is a fragmentary cross-sectional view taken along line C-C in FIG. 13.
Figure 15:
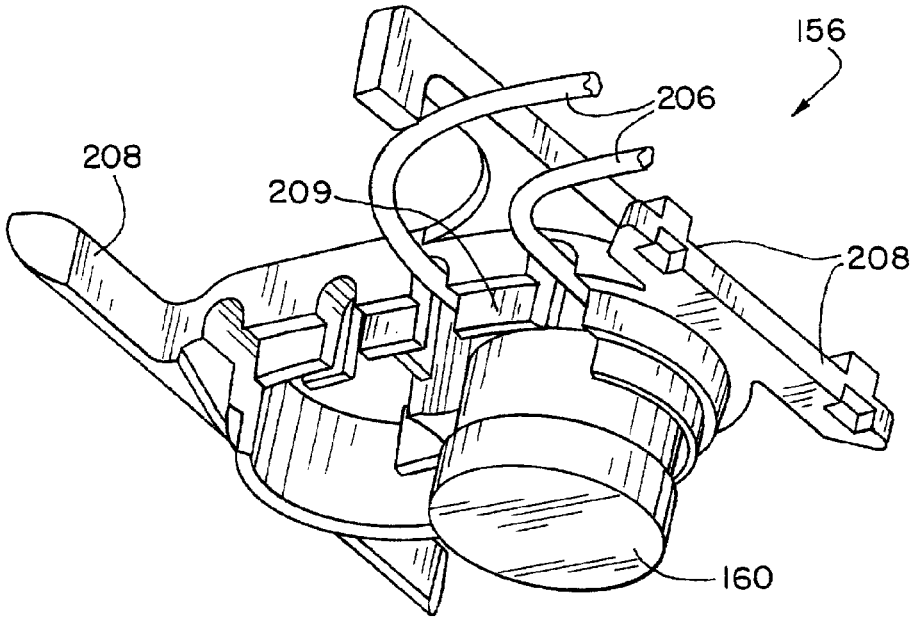
FIG. 15 is a perspective view showing the thermostat assembly in FIG. 13.

Control system cavity 132 is thermally coupled with water cavity 130 such that control system cavity 132 is configured for selectively retaining one of at least two differently configured control systems 153 configured for sensing and/or regulating the temperature of the water in water cavity 130. Thus, differently configured control systems 153 can be selectively utilized in control system cavity 132 to control, directly or indirectly, via valve assemblies 28 the volume and temperature of the water flowing through vacuum break assembly 12 via water cavity 130. The at least two differently configured control systems 153, thus, includes a thermistor assembly 154 (as shown in FIGS. 10-12), a thermostat assembly 156 including only one thermostat 160 (as shown in FIGS. 13-15), and a thermostat assembly 158 including two thermostats 160 (as shown in FIGS. 7-8, 16-18). For instance, while FIGS. 7-8 show control system cavity 132 including thermostat assembly 158 with two thermostats 160, thermistor assembly 154 or, alternatively, thermostat assembly 156 with a single thermostat 160 could be substituted for thermostat assembly 158 in FIGS. 7-8. Control system 153 is being used as generic terminology herein; that is, control system 153 includes control systems 154, 156, 158, as well as other types of control systems. Control system 153, such as the thermostat assembly, associated with control system cavity 132 can include single or dual bimetal strips, rounds, and/or coils. Accordingly, control system cavity 132 serves as a universal part which can selectively accommodate differently configured control systems 154, 156, and 158, as well as other types of differently configured control systems. Alternatively, water vacuum break assembly 12 can be used without a control system being mounted in control system cavity 132.

Control system cavity 132 can be shaped generally as a rectangle having curved or semi-circular longitudinal ends 162, as shown in FIG. 9. Control system cavity 132 can generally include a bottom wall 164, a side wall 166, and an open top 168. Top 168, for instance, can be closed by inserting one of control systems 154, 156, 158 into control system cavity 132; that is, each of the plurality of control systems 154, 156, 158 is configured to cover control system cavity 132. Bottom wall 164 can be substantially flat. Bottom wall 164 can also be completely or substantially coextensive with common wall 146; that is, bottom wall 164 and common wall 146 can be the same structure, substantially the same structure, the same structure in part but not in at least one other part, or wholly different structures relative to one another. For instance, common wall 146 can span and be at least partly coextensive with bottom wall 164 and side wall 166, as indicated in FIGS. 8-9.

Side wall 166 can include two curved sides 170, 172 and two longitudinal sides 174, 176. Curved sides 170, 172 are respectively disposed at longitudinal ends 162 of control system cavity 132. Curved sides 170, 172 include a first curved side 170 and a second curved side 172, second curved side 172 being disposed nearer proximal end 134 than first curved side 170. Longitudinal sides 174, 176 include a first longitudinal side 174 and a second longitudinal side 176, both longitudinal sides 174, 176 running generally in a direction from proximal end 134 toward distal end 136. Side wall 166 extends completely around the circumference of control system cavity 132, extends substantially upwardly from bottom wall 164, and can terminate in a raised lip 178. Lip 178 serves to prevent water, soap suds, and/or other liquids from getting into control system cavity 132 in the event that water, soap suds, and/or other liquids happen to splash or otherwise get onto top surface 152. Lip 178, thus, enables control system cavity 132 and control system 153 to survive flooding conditions. Lip 178 can extend completely around the circumference of control system cavity 132 and can extend above top surface 152 of housing 126 in a generally vertical direction. Side wall 166 can include a generally horizontal ledge 180 extending either completely or only partially around the circumference of control system cavity 132. Ledge 180 can serve as a mounting platform for various control systems, such as thermistor assembly 154 and thermostat assemblies 156, 158.

First longitudinal side 174 of side wall 166 can include a thermistor contacting portion 182 which is approximately centered between longitudinal ends 162, as shown in FIG. 9. Thermistor contacting portion 182 generally includes three sections including a first section 184, a second section 186, and a third section 188. The second section 186 is respectively substantially longer than each of first and third sections 184, 188 and is generally parallel to second longitudinal side Second section 186, however, is offset in a direction away from second longitudinal side 176. First and third sections 184, 188 serve as transition sections for offsetting second section 186. First and third sections 184, 188, thus, each extend at an angle, which can be less than ninety degrees, to second longitudinal side 176 in a direction away from second longitudinal side 176 but in a manner such that first and third sections 184, 188 generally approach one another as first and third sections 184, 188 approach second section 186. Ledge 180 may terminate either prior to or in thermistor contacting portion 182 such that ledge 180 does not extend completely around the circumference of control system cavity 132. Ledge 180 can taper and ultimately terminate in first and third sections 184, 188 or substantially at a junction of first and second sections 184, 186 and substantially at a junction of second and third sections 186, 188.

Housing 126 of vacuum break assembly 12 includes attachment features 190 for securing control system 153 inside control system cavity 132 and to housing 126, as shown in FIG. 9. Attachment features 190 can selectively accommodate a plurality of control systems 153 including thermistor assembly 154, thermostat assembly 156 including a single thermostat 160, or thermostat assembly 158 including two thermostats 160. Attachment features 190 provide a snap-fit for control systems 154, 156, 158. Attachment features 190 include four snap locks, two snap locks located near first curved side 170 of control system cavity 132 and two snap locks located near second curved side 172 of control system cavity 132. Housing 126 can further include a cutout 192 disposed near first curved side 170 of control system cavity 132 to accommodate a portion of control system 153.

Thermistor assembly 154 includes a thermistor 194, a cover 196 for overlaying control system cavity 132, and a wall 198 that mates with second section 186 of thermistor contacting portion 182, as shown in FIGS. 10-12. Both thermistor 194 and wall 198 can contact second section 186 when inserted into control system cavity 132. Thermistor assembly 154 can be mounted atop ledge 180 using a mounting wall 203 on thermistor assembly 154. Cover 196 can mount atop lip 178 or overhang and arch over lip 178. Thermistor assembly 154 serves to sense and/or regulate the water temperature in water cavity 130. Thermistor assembly 154 can include wires 200 extending therefrom to a washing machine. Thermistor assembly 154 further includes attachment features 202 for coupling with one or more housing attachment features 190. The coupling of thermistor assembly 154 with housing 126 can be a snap-fit.

Thermostat assembly 156 includes a single thermostat 160 and a cover 204 for overlaying control system cavity 132, as shown in FIGS. 13-15. Single thermostat 160 can be situated at or near first curved side 170 or second curved side 172 of control system cavity 132. Single thermostat 160 can contact bottom wall 164 of control system cavity 132. Thermostat assembly 156 can be mounted atop ledge 180 using a mounting wall 209 on thermostat assembly 156. Cover 204 can mount atop lip 178 or overhang and arch over lip 178. Thermostat assembly 156 serves to sense and/or regulate the water temperature in water cavity 130. Thermostat assembly 156 can include wires 206 extending therefrom to a washing machine. Thermostat assembly 156 further includes attachment features 208 for coupling with one or more housing attachment features 190. The coupling of thermostat assembly 156 with housing 126 can be a snap-fit.

Figure 16:
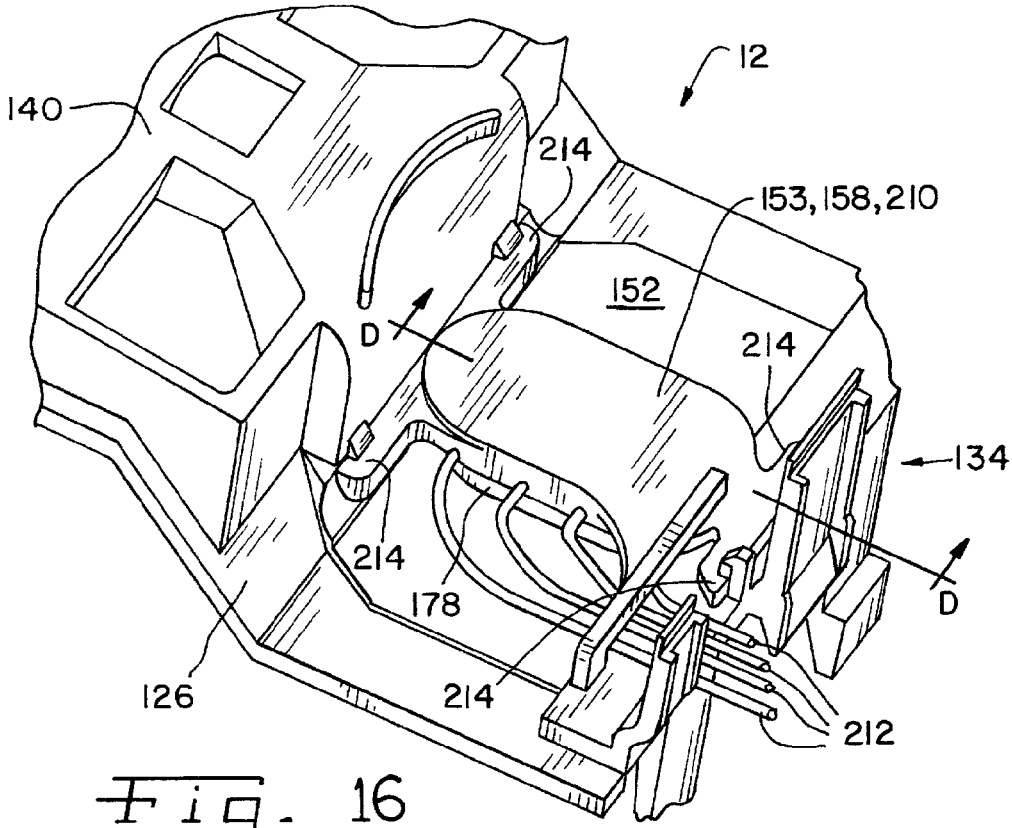
FIG. 16 is a fragmentary perspective view of the water vacuum break assembly in FIG. 7, with portions broken away, showing a top section of the water vacuum break assembly and the thermostat assembly with two thermostats.
Figure 17:
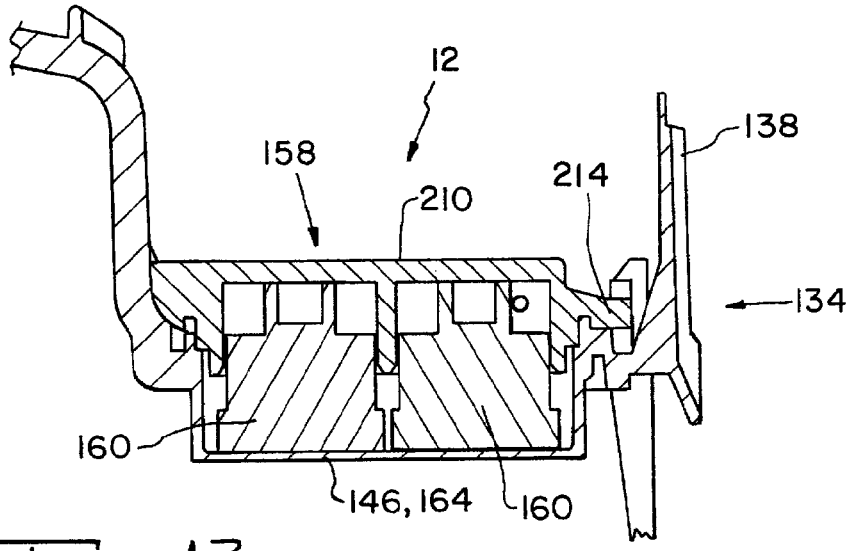
FIG. 17 is a fragmentary cross-sectional view taken along line D-D in FIG. 16.
Figure 18:
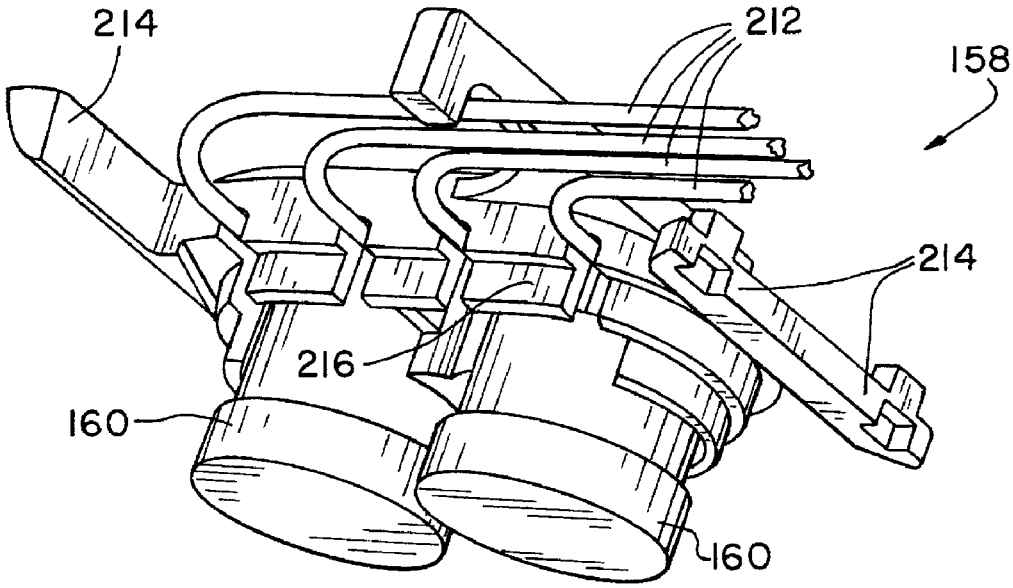
FIG. 18 is a perspective view showing the thermostat assembly in FIG. 16.

Thermostat assembly 158 includes two thermostats 160 and a cover 210 for overlaying control system cavity 132, as shown in FIGS. 16-18. Each thermostat 160 can be situated at or near one of curved sides 170, 172 of control system cavity 132. Each thermostat 160 can contact bottom wall 164 of control system cavity 132. Thermostat assembly 158 can be mounted atop ledge 180 using a mounting wall 216 on thermostat assembly 158. Cover 210 can mount atop lip 178 or overhang and arch over lip 178. Thermostat assembly 158 serves to sense and/or regulate the water temperature in water cavity 130. Thermostat assembly 158 can include wires 212 extending therefrom to a washing machine. Thermostat assembly 158 further includes attachment features 214 for coupling with one or more housing attachment features 190. The coupling of thermostat assembly 158 with housing 126 can be a snap-fit. Accordingly, each of control systems 154, 156, 158 is configured for interacting with at least some of the same attachment features 190 on housing 126 of water vacuum break assembly 12.

In the assembly process of one embodiment of the vacuum break assembly of the present invention, provided is water vacuum break housing 126 defining at least one water inlet opening 128, water cavity 130 fluidly connected with at least one water inlet opening 128, and control system cavity 132 positioned proximate water cavity 130, control system cavity 132 being configured for selectively retaining one of at least two differently configured control systems 153 including a first control system. The first control system is inserted in control system cavity 132, the first control system being configured for sensing and/or regulating the temperature of the water in water cavity 130. The first control system is retained in control system cavity 132. The first control system can be retained in control system cavity 132 by snap-fit using attachment features 190 and 202, 208, or 214. The first control system includes thermistor assembly 154, thermostat assembly 156 including a single thermostat 160, or thermostat assembly 158 including two thermostats 160. Housing 126 can include common wall 146 separating water cavity 130 and control system cavity 132. Upon retaining the first control system in control system cavity 132, the first control system can sense and/or regulate the water temperature in water cavity 130. Valve assemblies 28 can be utilized to regulate water flow into water cavity 130.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of assembling a water vacuum break assembly for use in a washing machine, said method comprising the steps of:

providing a water vacuum break housing defining at least one water inlet opening, a water cavity fluidly connected with said at least one water inlet opening, and a control system cavity positioned proximate said water cavity, said control system cavity configured for selectively retaining one of at least two differently configured control systems, said control systems including a first control system and a second control system, said control system cavity including a first curved side, a second curved side opposing said first curved side, a first longitudinal side, and a second longitudinal side opposing said first longitudinal side, said first longitudinal side and said second longitudinal side connecting said first curved side and said second curved side together, said first longitudinal side including an offset section which is parallel to and offset in a direction away from said second longitudinal side;

inserting said first control system in said control system cavity, said first control system configured for at least one of sensing and regulating a temperature of water in said water cavity;

retaining said first control system in said control system cavity, said first control system being positioned proximate at least one of said first curved side and said second curved side;

removing said first control system from said control system cavity;

inserting said second control system in said control system cavity, said second control system configured for at least one of sensing and regulating said temperature of water in said water cavity; and retaining said second control system in said control system cavity, said second control system contacting said offset section.

2. The method of claim 1, wherein said first control system includes a thermistor assembly.

3. The method of claim 1, wherein said first control system includes a thermostat assembly.

4. The method of claim 1, wherein said housing includes a common wall separating said water cavity and said control system cavity.

5. The method of claim 1, wherein said first control system is a thermistor assembly and said second control system is a thermostat assembly.

* * * * *